US012714162B2

(12) United States Patent
Halsted

(10) Patent No.: US 12,714,162 B2
(45) Date of Patent: Aug. 25, 2026

(54) TRAINING SWIMWEAR FOR ADDRESSING INJURY RISK FACTORS

(71) Applicant: The Regents of the University of California, Oakland, CA (US)

(72) Inventor: Tara Kathleen Halsted, Davis, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 17/366,774

(22) Filed: Jul. 2, 2021

(65) Prior Publication Data

US 2023/0000181 A1 Jan. 5, 2023

(51) Int. Cl.
*A41D 7/00* (2006.01)
*A41D 31/18* (2019.01)

(52) U.S. Cl.
CPC ..... *A41D 7/00* (2013.01); *A41D 31/18* (2019.02)

(58) Field of Classification Search
CPC .... A41D 7/00; A41D 13/0125; A41D 13/012; A41D 7/001; A41D 7/003; A41D 2400/24; A41D 2600/10; A63B 69/12; B63C 9/115; B63C 9/093; B63C 9/087; B63C 9/125; B63C 9/1255; B63C 9/11; B63C 9/08; A41F 3/02
USPC ..... 2/69; 441/107
See application file for complete search history.

(56) References Cited

U.S. PATENT DOCUMENTS 679,502 A * 7/1901 Graham ..... B63C 9/115 441/115
832,999 A * 10/1906 Petrie ..... B63C 9/1255 441/111
1,950,937 A * 3/1934 Brown ..... B63C 9/115 441/110

(Continued)

FOREIGN PATENT DOCUMENTS

GB 2074010 A * 10/1981 ..... A41D 13/0007
GB 2475516 A * 5/2011 ..... A41D 13/0125
WO WO-2018198389 A1 * 11/2018 ..... B63C 9/08

OTHER PUBLICATIONS

Allegrucci, M. et al.; "Clinical Implications of Secondary Impingement of the Shoulder in Freestyle Swimmers"; *Journal of Orthopaedic & Sports Physical Therapy*; vol. 20, No. 6; 1994; pp. 307-318.

(Continued)

*Primary Examiner* — Grady Alexander Nunnery
(74) *Attorney, Agent, or Firm* — Kilpatrick Townsend and Stockton LLP

(57) ABSTRACT

Disclosed is a training swimwear garment which include a base layer suitable to cover at least a portion of the upper torso of a wearer, the base layer having an abdomen region, a shoulder region, and a back region, and the base layer includes compressive and non-compressive fabric. The training swimwear includes a plurality of elastic straps spanning from an anterior of the shoulder region to the back region, configured to provide tension to produce a desired shoulder posture of the wearer. The training swimwear includes a plurality of panels connected with the base layer, the panels including an abdomen panel covering the abdomen region, and a back panel covering the back region, and the panels are configured to be buoyant to produce a desired body posture of the wearer.

21 Claims, 3 Drawing Sheets

(56) References Cited

U.S. PATENT DOCUMENTS

| | | | | | |
|---|---|---|---|---|---|
| 2,081,687 | A * | 5/1937 | Temchin | A41D 7/003 | D2/731 |
| 3,199,128 | A * | 8/1965 | Nojd | B63C 9/093 | 441/89 |
| 3,745,588 | A * | 7/1973 | Pehle | A41F 9/02 | 2/221 |
| 3,866,617 | A * | 2/1975 | Gluckin | A41C 3/00 | 450/60 |
| 4,767,371 | A * | 8/1988 | Jackson | B63C 9/1055 | 411/116 |
| 5,338,239 | A * | 8/1994 | Cleaveland | B63C 9/1255 | 441/106 |
| 5,623,735 | A * | 4/1997 | Perry | A41F 3/02 | 2/326 |
| 5,937,442 | A * | 8/1999 | Yamaguchi | A41D 31/18 | 2/69 |
| 6,112,327 | A * | 9/2000 | Shaffer | A41D 7/003 | 441/120 |
| 8,591,275 | B2 * | 11/2013 | Gonsalves | B63C 9/115 | 441/106 |
| 2003/0109186 | A1 * | 6/2003 | Steger | B63C 9/115 | 441/88 |
| 2004/0133959 | A1 * | 7/2004 | Horii | A41B 9/06 | 2/69 |
| 2004/0231025 | A1 * | 11/2004 | Herman | A41D 7/001 | 2/67 |
| 2008/0141430 | A1 * | 6/2008 | Rance | A41D 7/00 | 2/243.1 |
| 2012/0266347 | A1 * | 10/2012 | DiLorenzo | A41D 7/00 | 450/95 |
| 2014/0059734 | A1 * | 3/2014 | Toronjo | A43B 3/26 | 2/69 |
| 2014/0090142 | A1 * | 4/2014 | Waller | A41D 13/0015 | 2/67 |
| 2014/0313037 | A1 * | 10/2014 | Canales | A61B 5/486 | 2/67 |
| 2016/0050994 | A1 * | 2/2016 | Bushby | A41B 9/06 | 2/243.1 |
| 2017/0318864 | A1 * | 11/2017 | Carroll | A41B 9/04 | |
| 2018/0317562 | A1 * | 11/2018 | Gagliardo | A41D 13/0531 | |
| 2019/0350290 | A1 * | 11/2019 | Blake | A42B 1/046 | |
| 2020/0214368 | A1 * | 7/2020 | Blakely | B32B 7/14 | |
| 2021/0145084 | A1 * | 5/2021 | Szilagyi | A41D 31/18 | |

OTHER PUBLICATIONS

Braun, B.L. et al.; "Quantitative Assessment of Head and Shoulder Posture"; *Archives of Physical Medicine and Rehabilitation*; vol. 70, Apr. 1989, pp. 322-329.

Hajibashi, Arghavan, et al.; "Effect of Kinesiotaping and Stretching on Forward Shoulder Angles in Females with Rounded Shoulder Posture"; *Journal of Rehabilitation Science and Research*; vol. 1, No. 4; Dec. 2014; pp. 78-83.

Halsted, T. et al.; "Design 4 Health 6th International Conference"; *Proactive Design for Injury Prevention of Elite Swimmers*; 2020.

Johnson, J.N, et al.; "Swimming Biomechanics and Injury Prevention: New Stroke Techniques and Medical Considerations"; *The Physician and Sportsmedicine*; vol. 31, No. 1; 2003; pp. 41-46.

Johnson, J.E, et al.; "Musculoskeletal Injuries in Competitive Swimmers"; *Mayo Clinic Proc*; vol. 62; Apr. 1987; pp. 289-304.

Kammer, C.S. et al.; "Swimming Injuries and Illnesses"; *The Physician and Sportsmedicine*; vol. 27, No. 4; 1999; pp. 51-60.

Kraemer, W.J. et al.; "Influence of Compression Therapy on Symptoms Following Soft Tissue Injury from Maximal Eccentric Exercise"; *Journal of Orthopaedic & Sports Physical Therapy*; vol. 31, No. 6; 2001; pp. 282-290.

Kritz, M.F. et al.; "Static Posture Assessment Screen of Athletes: Benefits and Considerations"; *National Strength and Conditioning Association*, vol. 30, No. 5; Oct. 2008; pp. 18-27.

Letafatkar, A. et al.; "Comparing the Effects of No Intervention with Therapeutic Exercise, and Exercise with Additional Kinesio Tape in Patients with Shoulder Impingement Syndrome. A Three-Arm Randomized Controlled Trial"; *Clinical Rehabilitation*; 2020; pp. 1-10.

Lewis, J.S. et al.; "Subacromial Impingement Syndrome: The Effect of Changing Posture on Shoulder Range of Movement;" *Journal of Orthopaedic & Sports Physical Therapy*; vol. 35, No. 2; Feb. 2005; pp. 72-87.

Morrissey, D.; "Proprioceptive Shoulder Taping"; *Journal of Bodywork and Movement Therapies*; Jul. 2000; pp. 189-194.

O'Donnell, C.J. et al.; "Identifying and Managing Shoulder Pain in Competitive Swimmers"; *The Physician and Sportsmedicine*; vol. 33, No. 9; 2005; pp. 27-35.

Pink, M.M. et al.; "The Painful Shoulder in the Swimming Athlete"; *Conservative Management of Shoulder Injuries*; vol. 31, No. 2; Apr. 2000; pp. 247-261.

Richardson, A.B., et al.; "The Shoulder in Competitive Swimming"; *The American Journal of Sports Medicine*; vol. 8, No. 3; 1980; pp. 159-163.

Wanivenhaus, F., et al.; "Epidemiology of Injuries and Prevention Strategies in Competitive Swimmers"; *Sports Health*; vol. 4, No. 3; 2012; pp. 246-251.

Wolf, B. R., et al.; "Injury Patterns in Division I Collegiate Swimming"; *The American Journal of Sports Medicine*; vol. 37, No. 10; pp. 2037-2042.

* cited by examiner

TRAINING SWIMWEAR FOR ADDRESSING INJURY RISK FACTORS

BACKGROUND

Shoulder injuries are common in swimmers due to high training volume, postural issues resulting from improper position of joints in relation to one another due to imbalance in strength and flexibility, and technical flaws, such as improper movements in the stroke patterns. Addressing these issues is crucial in reducing the likelihood of injury as well as improving performance. Research shows that the majority of injuries take place during training, frequently from overuse, due to the repetitive nature of the strokes, technical issues, magnified by fatigue, and anatomical variants such as shoulder instability. Training in a fatigued state is necessary to increase endurance and attain beneficial training volume, however the degradation of stroke technique from fatigue can cause poor posture and improper muscle engagement, leading to increased risk for injury or agitating healing injuries.

Swimwear companies seek credibility and public exposure by focusing their research and development on innovation of technical suits worn in competition rather than during training. However, these competition suits are reserved for racing because they are uncomfortable to wear for long durations, expensive, and the fabric integrity does not withstand chlorine well. The design focus for training suits is for comfort and longevity, but fails to provide technical advantages and training benefits for the swimmer.

SUMMARY

Embodiments of the present invention are directed to swimwear garments designed for training (non-competition) applications. The swimwear garment helps to improve form and positioning in the water to reduce injuries, as well as assists injured swimmers recover from injuries already sustained, such that the swimmers can continue training while recovering from injury. More specifically, swimwear garments according to the embodiments of the invention are focused on addressing injury risk factors by promoting core muscle activation and raising body position in the water and improving shoulder posture to help reduce the possibility of injury and to provide a garment for recovering swimmers to assist posture and correct swimming form.

Swimmers often have a forward-slumped posture due to an imbalance in anterior and interior shoulder strength, which increases the load on the shoulder during swimming. Anatomical variations, such as excessive laxity and lack of anterior flexibility are correlated to further increase in shoulder pain. Butterfly, backstroke, and freestyle swimming stokes involve similar shoulder movements, so many swimmers suffer from similar injuries despite specializing in different events. Overuse is difficult to control because it is inherent to the training regimen and the fitness demands of the sport. However, posture and body position can be manipulated through a garment, alleviating or minimizing the negative effects of high-volume training demands.

In one aspect, the swimwear garment can go over a traditional swimming suit or training suit. It can also be worn directly against the skin. The swimwear garment can be designed to be very tight on the wearer when it is dry, such that it can be put on when dry, but once the garment and the wearer enter the water, the garment fits properly, rather than expanding to be too large in the water.

In another aspect, the swimwear garment includes a base layer covering at least part of the upper body of the wearer. The base layer may be of one material or may include at least two different fabric types. One of the fabric types may be a compressive fabric, and can be similar to a traditional racing suit or swimsuit fabric. Other fabrics which satisfy similar compressive and stretch features as described herein, are also contemplated. The compressive fabric can cover areas of the chest and arms. These are the primary areas where a swimsuit generally provides the most compression on the swimmer's muscles, as described herein. The compressive fabric should be capable of stretching, but not at the expense of providing compression on the swimmer's body.

The base layer of the garment may also include a second fabric type which is less compressive than the compressive fabric. In some embodiments this fabric is a breathable mesh fabric, such as an athletic mesh or performance nylon spandex power mesh. The mesh fabric can be used for areas of the swimming garment where compression is less desirable, such as areas of the back. Using mesh where compression is not necessary allows for breathability of the garment and reduces weight.

In another aspect of the swimwear garment, one or more elastic straps (or strips) are connected to the swimwear garment over the shoulders and upper back to add additional support and posture control to the shoulders. The straps support the shoulders in a neutral position and reinforce habits of proper posture, especially when fatigue increases the forward-slumping of the shoulders. In a swimmer with rolled forward, rounded shoulders, lifting the arm can cause impingement. This is significant because the swimming strokes all have an overhead catch phase, in which the arm is generating propulsion to move the swimmer forward in the water. These elastic straps target specific areas to control and support movements, and can be based on Kinesio taping methods. The elastic shoulder strap placement can also or alternatively be based on Morrisey's clinical taping methods. The shoulder strips can be specifically placed to run from the anterior shoulder to the center of the back, to apply force to pull the protracted shoulders back from a rounded position into a neutral position. These elastic straps can be made from waistband elastic, for example, or similar material.

In another aspect of the swimwear garment, panels on the front and back of the garment are used to provide buoyancy and core compression. The panels can be made from a buoyant material, such as neoprene or other buoyant material. The panels can be positioned around the swimmer's core muscles to add buoyancy to the swimmer and address fatigue-related body position changes due to slowing of the kicking motion and by the swimmer dropping their hips.

The panels can also provide additional tightness and compression to support certain areas of the swimmer, as the paneled areas stretch less than the areas with only the base shell fabrics. The panels act to counter the effect of fatigue-related issues, such as lack of core engagement. A lack of core engagement and inadequate rotation while swimming are also linked to improper use of muscles. Core compression with the panels can promote increased awareness of the muscles and to counteract the injury risk factor. Such core awareness improves rotation, which lessens the load on the shoulders and increases engagement between the swimmers core and the kick aspect of their swimming stroke. While compression is desirable in certain areas of the body, it is desirable to avoid in other areas. For example, the panels can be positioned to avoid excessive compression of the rib cage and lung area, which could otherwise reduce the swimmers lung capacity and can impinge on natural breathing patterns.

In some aspects, the panels can also have one or more auxetic cuts or perforations. The auxetic cuts provide ease of movement and flexibility while maintaining compression. The auxetic cuts allow the neoprene or similar material of the panels to stretch and bend when the swimmer bends their core, such as during a flip turn or other swimming motion. These auxetic cuts provide the benefit of flexibility without compromising the compression provided by the panels. The auxetic cuts or perforations also allow flexibility for ease of donning and doffing the suit. Such ease of removal can be particularly advantageous for fatigued or injured swimmers who have limited flexibility or movement related pain. The auxetic cuts can be of various designs to emphasize stretching in particular directions, and can be of varying depth through the panels, as can be understood of one skilled in the art.

The terms "invention," "the invention," "this invention" and "the present invention" used herein are intended to refer broadly to all of the subject matter of this specification and the claims below. Statements containing these terms should not be understood to limit the subject matter described herein or to limit the meaning or scope of the patent claims below.

The term "compressive fabric" as used herein means a fabric type intended to apply pressure or tightness to the area of the body which it covers. Conversely, the term "non-compressive fabric" means a fabric which does not have the intended quality of applying pressure or tightness to the area of the body which it covers, but should be understood to mean that some pressure may be applied as is inherent with fabric generally. Further "compressive fabric" and "non-compressive fabric" can be defined as degrees of pressure or force applied to the wearer of the garment in relation to each other, such that the non-compressive fabric applies less force on the wearer than the compressive fabric.

Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION OF THE DRAWINGS

The following detailed description of example implementations refers to the accompanying drawings. The same reference numbers in different drawings may identify the same or similar elements. In the following description, for the purpose of explanation, numerous specific details are set forth in order to provide an understanding of various embodiments of the subject matter. It will be evident, however, to those skilled in the art, that embodiments of the inventive subject matter may be practiced without these specific details. In general, well-known structures and techniques are not necessary shown in detail.

The need for improved swimwear has existed for some time. For example, throughout the $20^{th}$ century, rapid development and advancement in synthetic fibers, such as nylon and polyester, have encouraged a change in swimwear from traditional natural fibers to more water resistant and practical synthetic fabric. Development and advancement in the field was driven by not only a desire for comfort and fashion, but performance in limiting drag in the water and functionality in durability and water shedding ability.

In general terms, the inventor found that swimsuits to be worn on a regular basis, outside of competition events, lack sophistication and technical innovation which can assist the swimmer in training gains and increased performance. As the vast majority of a swimmer's routine swimming is spent in training swimwear, rather than in a racing suit, the inventor sought to develop advanced training garments to address training injury risk factors. The swimwear is designed to assist the swimmer develop and improve their form in their (often daily) training routines, while also providing a garment which minimizes drag in the water, avoids complexity or discomfort in donning and doffing, and is durable to chlorine and sun exposure.

While the various embodiments of swimwear garments shown herein are generally shown as being unisex and of particular sizing ratios, it should be understood that the swimwear garments can also be specifically shaped and designed for a particular gender, such as with adjusted hip and chest dimensions. Further, as each swimmer can have different body figures, varying sizes of the swimwear shown can be developed to specifically and more precisely fit a particular body shape.

The various embodiments of swimwear garments herein show figures which end on or near the waist of the swimmer. It may be advantageous to have a garment which ends at the waist to limit weight, drag, and complexity in putting on or taking off the garment. However, it should be understood that while the features of this garment are demonstrated as being only on the upper body, the garment could also extend around the torso or to the leg region.

Figure 1A:
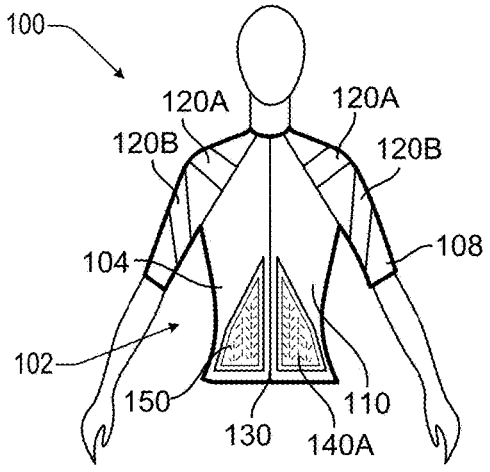
FIG. 1A is a front view of the swimwear garment according to embodiments of the disclosure.
Figure 1B:
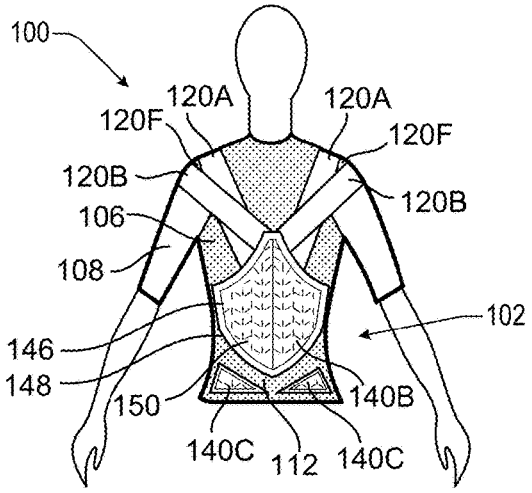
FIG. 1B is a rear view of the swimwear garment of FIG. 1A.

FIGS. 1A and 1B illustrates a front view and rear view, respectively, of a swimwear garment 100 for training in the water. The garment 100 with a base layer 102 made from compressive fabric 104 and non-compressive fabric 106. For explanatory purposes, the garment 100 is described as having a front section 110 and a back section 112 to describe the front and back of the garment 100 generally. The base layer 102 can cover the upper body of the wearer, and can further comprise sleeves 108 extending down the arms of the wearer. While the garment 100 is shown with sleeves 108 extending only to the mid-arm (short sleeves), it is further contemplated to have long sleeves extending for example to the wrist, even shorter sleeves extending only to the mid or upper bicep, or no sleeves at all.

The front section 110 of the base layer 102 is constructed from compressive fabric 104, covering the chest and shoulders of the wearer. The compressive fabric can have about a 70% stretch factor in the lengthwise direction (meaning a 10 inch long section could be stretched to 17 inches), and a 100% stretch factor in the crosswise direction. The compressive fabric can be made primarily of polyester, and optionally can also be made partially of spandex, preferably being about 90% polyester and about 10% spandex.

The back section 112 of the base layer 102 can be made at least primarily from non-compressive fabric 106. The non-compressive fabric can be made from at least nylon and spandex, preferably being made from a nylon-spandex blend of about 80% nylon and 20% spandex. Other fabrics which satisfy similar stretch features, as described, are also contemplated. The non-compressive fabric can additionally also allow for more leeway on sizing of the garment, as the flexibility of the non-compressive fabric can be more adaptable to varying body sizes and types. A suitable non-compressive or mesh fabric can have a stretch factor of about 70% in the grainline direction and 130% in the crosswise direction.

For ease of donning and doffing, the garment 100 can also be fitted with a zipper 130. As shown in FIG. 1A, the zipper 130 is positioned in the center of the front section 110. In other embodiments, the zipper 130 can be located in the center of the back section 112 (like a wetsuit for example). The zipper 130 as shown runs the entire length of the garment 100, such that the front section 110 fully separates when the zipper is opened. The full opening of the garment 100 and front opening allows for ease of donning and doffing the garment 100, such that generally no assistance is needed from anyone else to put it on. Additionally, the full length of the zipper 130 can be useful in the case of an injured swimmer with limited range of movement or pain associated with stretching in certain directions. In construction, the zipper can be a lightweight zipper such as a #3 nylon coil separating zipper made by YKK, or others. Such a lightweight zipper allows for decrease in both weight and drag when worn in the water.

In one aspect, the swimwear garment 100 includes a plurality of elastic straps 120, for example interior elastic straps 120A and exterior elastic straps 120B. The elastic straps 120 span the shoulder region of the wearer. In general, the garment 100 will have equal number of elastic straps 120 on each side of the wearers body (each side of the wearers head) to apply equal compression and positioning on each shoulder muscle region. Preferably the straps can be wide waistband fabric, about 2 inches wide. The material of the elastic straps should stretch around 60% in the lengthwise direction. Once attached to the base layer of the suit, the combined base layer and elastic straps can stretch (in combination) about 40%-50%. It is shown herein that the garment 100 has two elastic straps on each side of the wearers body, discussed and shown as the interior elastic straps 120A and exterior elastic straps 120B. The interior elastic straps 120A attach to the front section 110 at the base of the shoulder or pectoral region. The interior elastic straps 120A then span over the tops of the wearer's shoulder region and towards the center of the spine.

To help secure the elastic straps 120 to the base layer 102 it can be beneficial to sew the ends of the elastic straps 120 to the panels 140 of the garment 100 or into the seams of the base layer 102. If the elastic straps 120 are not sewn into a seam or another feature of the garment 100 it can cause the area where it is secured to stretch away from the remainder of the garment 100. Because the elastic straps 120 are stretched when worn, if they are not secured to a panel 140 or a seam of the base layer 102, it may result in the base layer 102 to pull and ride in an uncomfortable position on the wearer, or otherwise shift in place. In the embodiment shown in FIG. 1A, the interior elastic straps 120A are secured at the front within the seam where the sleeves 108 are attached to the front section 110. Similarly, the exterior elastic straps 120B attach at the front to the underarm seam which creates the sleeves 108 shape. On the back of the garment 100, the elastic straps 120 are attached and secured to the back section 112 by being sewn directly into the back panel 140B.

As shown in FIG. 1B, the exterior elastic straps 120B overlap the interior elastic straps 120A to attach to the back panel 140B. The overlapping is primarily a feature to allow the exterior elastic straps 120B to maintain the desired angle around the outside of the shoulder region. It should additionally be appreciated that the interior elastic strap 120A could instead overlap the exterior elastic strap 120B. Additionally, the interior elastic straps 120A and the exterior elastic straps 120B may merge together into one elastic strap at their point of intersection, and attach as one piece of material to the back panel 140B.

When the wearer puts on the garment 100, the elasticity of the base layer 102 allows the base layer to stretch and fit tightly against the wearer. As the base layer 102 is stretched, the elastic straps 120 also stretch, and in so doing force is applied on the wearer. Based on the specific placement of the elastic straps 120, force is applied in predetermined and selected directions to improve the wearers posture and positioning while swimming. For example, as seen in FIGS. 1A and 1B, the exterior elastic straps 120B are positioned at a more aggressive angle 120F relative to the interior elastic straps 120A, this resulting angle 120F pushes the protracted shoulder from a rounded position to a neutral position. Similarly, the interior elastic strap 120A goes more directly over the top of the shoulder, from the bicep to the spine of the upper or middle back, resulting in the elastic force pushing more directly downward on the shoulder. The resulting combination is a precise positioning of the shoulder by pushing it backwards and downwards simultaneously. In further embodiments, positioning and means in which the force is applied to the shoulders by elastic straps 120 can further be based on Kinesio taping methods, where the positioning is selected to treat pain and injured muscles by specific elastic strap configurations or shapes, such as a "Y", "X", "I", or fan/web shape. Additional elastic straps 120 can be used to effectuate the desired shape and provide the desired pressure to the muscles.

The desired amount of force applied to the shoulder can be determined based on the material selected for the elastic straps 120. A more resistive elastic material will push more strongly on the shoulder when worn by the wearer in comparison with a less resistive elastic material. The amount of force applied can also be varied by the length of the elastic straps when the garment 100 is manufactured. In some embodiments, for example, when the elastic straps 120 are attached to the garment 100, the elastic straps 120 are made shorter than the distance of the two points they are intended to attach. Thus, the elastic straps 120 are stretched when attached onto the garment 100, and thus the elastic straps are pre-stretched prior to being worn by the wearer. Therefore, once the wearer puts on the garment, the force applied to the shoulder will be both the pre-stretched force as well as the force added when the garment 100 is put on and the base layer 102 and elastic straps 120 are stretched further. Notably, manufacturing determinations can be made specifically for each of the elastic straps 120, such that more force is applied from the interior elastic straps 120A than the exterior elastic straps 120B, or vice versa. Such determinations may be appropriately made by a physical therapist or other sports trainer for best results for a particular wearer, or generally for a specific swimming event.

In some embodiments, to add additional comfort and support to the wearer, the elastic straps 120 may further include a protective coating covering at least the inside portion of the elastic straps 120, or preferably both sides of the elastic straps 120. Such a protective coating can, for example, be made from polyester and add additional comfort such that the elastic straps 120 do not rub or chafe the wearer. The protective coating may also have the added benefit of protecting the elastic straps 120 from wear and tear from use, and protect the elastic straps 120 from sun exposure.

In another aspect of the garment 100 shown in FIGS. 1A and 1B, the garment 100 has a plurality of panels 140, for example abdomen panels 140A, a back panel 140B, and oblique panels 140C. In one aspect, the panels 140 are designed to be buoyant. For example, the panels 140 can be made of neoprene. For example, the panels 140 can be made of closed-cell neoprene and can be about ⅜" thick, for example Neoprene High Quality Foam sold by The Foam Factory based in Macomb, Mich.

Figure 4A:
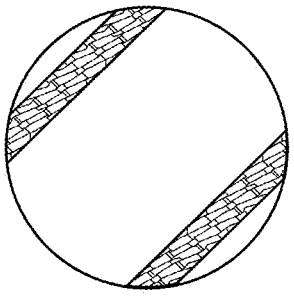
FIG. 4 is a detailed view of exemplary stitching patterns.
Figure 4B:
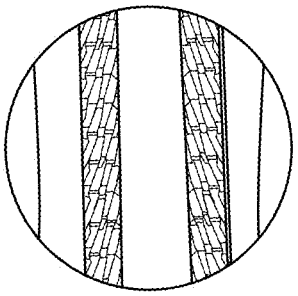

To attach the panels 140 to the base layer 102 several stitching patterns can be used to sew the panels 140 to the base layer 102. The panels 140 can be sewn to the base layer at or near the panel edge 146. With larger panels, such as the back panel 140B, stitching can be added down the middle of the panel 140B to provide additional support and secure attachment to the base layer 102. When sewing the panels 140 to the base layer 102 the panels 140 are generally too thick to use a complex stitching type (such as a cover stitch). In some embodiments, a cover layer of compressive fabric 104 can be used for some or all of the panels 140 of the garment 100. In such embodiments, a section of compressive fabric 104 can be cut slightly larger than the panel 140 it is intended to cover. For example, the cover layer may be about an inch larger in all directions than the panel 140 it will cover. As shown in FIGS. 1A and 1B the panels 140 have a panel edge 146 and the cover layer has a cover layer edge 148, where the cover layer edge 148 approximately matches the shape of the panel edge 146, but the section of compressive fabric 104 which makes the cover layer is slightly larger than the underlying panel 140. Once a panel 140 is sewn to the base layer 102, the cover layer of compressive fabric 104 can be placed over the top of the panel 140 and the cover layer edge 148 can be sewn directly to the base layer 102. As such, the cover layer creates a pocket in which the panel 140 is secured. Once constructed, the panel 140 can then be fully protected from sun exposure or damage from use. Because the cover layer edge 148 is sewn to the base layer 102 and not to the panels 140, there is not an issue with the thickness of what is being sewn, so more complex stitching patterns can be used to provide increased durability, comfort, and decreased drag in the water. For example, a double sided 5 thread cover stitch can be used, as discussed further in FIG. 4.

In some embodiments, the panels 140 may further include auxetic cuts 150, which can be cut fully or partially into the material of the panels 140. The auxetic cuts 150 allow for increased motion and flexibility while maintaining the desired compression on the wearer. The auxetic cuts 150 may be a variety of shapes to accommodate different directions where increased flexibility and motion is required. The specifics of auxetic cuts are further provided regarding FIGS. 5A and 5B.

The garment 100 may have abdomen panels 140A attached to the base layer 102 in the abdomen region of the front section 110. As shown in FIG. 1A, there are two abdomen panels 140A, separated by the zipper 130. The abdomen panels 140A can be substantially triangular in shape, covering a substantial portion of the abdomen region of the wearer. In some embodiments, the abdomen panels 140A can be about 11 inches tall, 5.5 inches wide, and have a hypotenuse of 8 inches (when the shape is triangular). Rather than a true triangle, in some embodiments, the hypotenuse edge of the abdomen panels 140A has a slight angle change, where the hypotenuse edge extends more vertically towards the waist of the wearer, and a more horizontal angle as it goes upwards on the wearer. These angles are provided to accommodate maximum coverage of the abdomen region of the wearer towards the waist, while tapering the angle to follow the bottom edge of the wearer's rib cage towards the top of the abdomen panels 140A. By extending along the rib cage, but not covering the rib cage, the abdomen panels 140A allow for maximum coverage of the abdomen region (for additional compression and buoyancy) without adding compression to the rib cage and lung area, which could restrict breathing. The abdomen panels 140A may further include a cover layer with a cover layer edge 148 extending slightly over the edges of the abdomen panels 140A (as discussed for all panels 140 above).

Additionally, the garment 100 may have at least one back panel 140B attached to the back section 112 of the garment 100. The embodiment of FIG. 1B is shown having one back panel 140B, but it should be understood that multiple panels either side-by-side or spaced above and below could be provided. Additional back panels 140B could be used to provide additional range of body motion or flexibility as desired in the back region. Such design decisions can be made based on particular swimming events or needs of a particular swimmer. The back panel 140B may further include a cover layer with a cover layer edge 148 extending slightly over the edges of the back panel 140B (as discussed for all panels 140 above).

The back panel 140B shown in FIG. 1B is similar in shape to a turtle shell, and can be 2 inches at the top center and expanding to a width of 6 inches in the middle of the back, and spanning about 11.5 inches from the top to bottom. The shape was selected to provide maximum comfort to the swimmer, for example in bending or curling in a flip turn or other large back bending movements in swimming. By providing the back panel 140B towards the waist of the wearer on the back section 112 it ensures that the back panel 140B does not interfere with the arm movements of the wearer. Further, the back panel 140B may be located closer to the waist of the wearer to provide buoyancy closer to the pelvic region, to particularly focus on raising the pelvic and leg region of the wearer in the water while swimming. The curved bottom edge of the back panel 140B was designed to allow the swimmer to bend without the bottom of the garment 100 moving or ridging up on the wearer. The top edge of the back panel 140B can be selected of a particular width and location to best receive the elastic straps 120 and provide a suitable attaching edge to sew the elastic straps 120 to the top area of the back panel 140B.

The garment 100 may also include oblique panels 140C at the back hips of the wearer. The oblique panels 140C are approximately triangular in shape, for example spanning about 4.5 inches along the waist, 4 inches in height, and 5.75 inches on the hypotenuse side. The oblique panels 140C may further include a cover layer with a cover layer edge 148 extending slightly over the edges of the oblique panels 140C (as discussed for all panels 140 above). The oblique panels 140C provide additional buoyancy near the waist of the wearer and further help elevate the legs and pelvic region of the wearer in the water.

The oblique panels 140C could alternatively be removed and a back panel 140B could instead be used that covers the region of both the back panel 140B and the oblique panels 140C of FIG. 1B. However, providing additional oblique panels 140C instead of only one back panel 140B allows for additional flexibility and range of motion without loss of substantial surface area for the panels 140, and therefore loss of substantial buoyancy force.

While it is discussed herein that the panels 140 and elastic straps 120 are secured on top of the base layer 102, it should be appreciated that the panels 140 and elastic straps 120 could be directly integrated into the base layer 102. To clarify for example, the base layer 102 could have holes cut to match the shape of each of the panels 140 such that the panels 140 are directly in contact with the skin of the wearer, rather than over the top of the base layer 102.

Figure 2A:
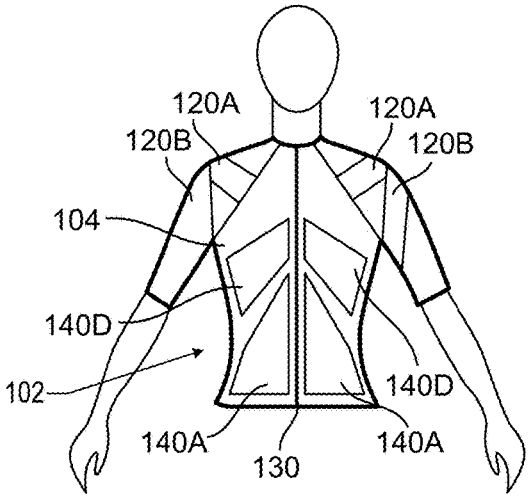
FIG. 2A is a front view of an alternative exemplary swimwear garment.
Figure 2B:
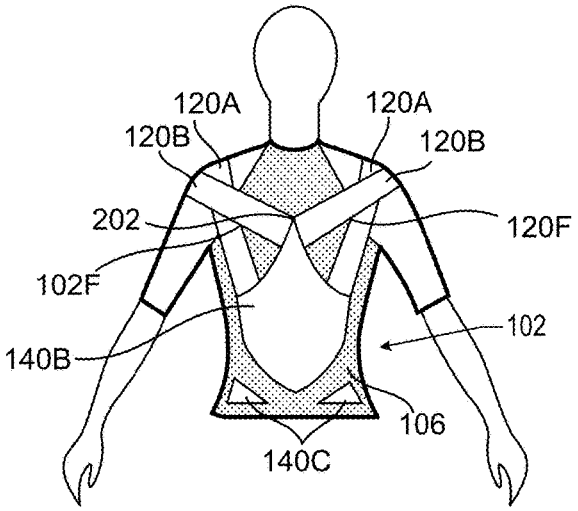
FIG. 2B is a rear view of the swimwear garment of FIG. 2A.

Referring now to FIGS. 2A and 2B, the figures show the front and back, respectively, of an alternative embodiment of a garment 100. FIG. 2A shows a garment 100 having two chest panels 140D. These chest panels 140D are located over the pectoral or breast region of the wearer, above the abdomen panels 140A, and provide additional buoyancy in the water. These chest panels 140D can be constructed of the same materials and attached to the base layer 102 in the same manner as the abdomen panels 140A.

Having panels 140 overlapping the rib cage and lung area can have both advantages and disadvantages. Applying additional compression to the rib cage with the use of chest panels 140D can result in added weight and pressure against the lungs, which can impede natural breathing difficulty and breathing patterns. However, adding chest panels 140D to the garment 100 provides substantially increased buoyancy and can assist in raising the body of the wearer in the water. For example, such panels can provide increased buoyancy in the shoulder and chest region, raising a swimmers head and arms.

As chest size and shaping can vary substantially between swimmers, particularly with regard to men and women, a garment 100 having chest panels 140D may be particularly suitable for gender-specific garments. In the case of a garment 100 that is intended to be unisex, the chest panels 140D can result in a less flexible (or even rigid) structure in the chest region, which is less capable of tightly forming to the body shape of the wearer. With variance in chest size and shape, such as with a unisex garment, the suit may not fit as tightly against the body.

It is also contemplated that the chest panels 140D can be of varying shape and size and be positioned in higher or lower on the body. Further additional (and smaller) chest panels could be provided in place of the chest panels 140D shown. Having multiple chest panels 140D on each side of the wearer may allow sustained flexibility of motion and a maintained elasticity of the suit to fit the wearer's form.

In FIG. 2B, an alternative embodiment of the elastic straps 120 is shown. As discussed previously, various configurations of the angles 120F and positions of the elastic straps 120 can provide the desired force and angle of the pressure applied by the elastic straps 120. Such angles and forces can be determined based on specific needs of a particular swimmer by, for example, a trainer or medical professional. In this embodiment, the exterior elastic straps 120B cross the interior elastic straps 120A higher on the back section 112, optionally overlapping each other on the top of the shoulder (as can be seen also in FIG. 2A). The exterior elastic straps 120B maintain a sharper angle 120F, spanning the back nearly at a directly horizontal angle. To accommodate this angle, the back panel 140B is shown to come to a point tip 202 at the top, and go higher into the back section 112 of the garment 100. As such, the pointed tip 202 of the back panel 140B is capable of receiving the exterior elastic strap 120B higher in the back section 112.

In FIG. 2B, the interior elastic straps 120A maintain a more vertical angle down the back section 112 of the garment 100. This more vertical angle can provide a desired direction of force on the shoulder in combination with the more horizontal angle of the exterior elastic straps 120B. FIG. 2B further shows the interior elastic straps can attach in alternative positions on the back panel 140B, such as further towards the outside of the back section 112.

Figure 3:
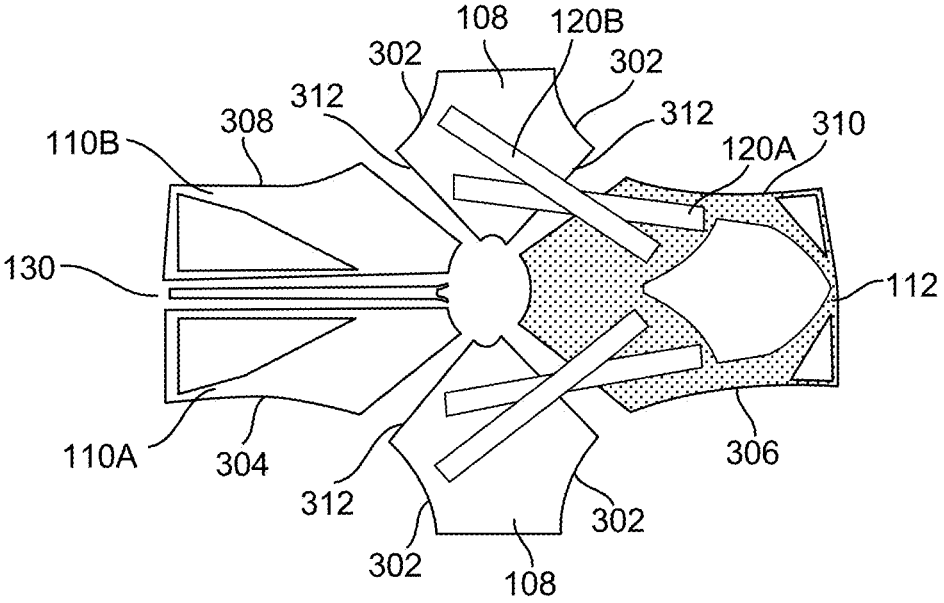
FIG. 3 is a deconstructed view of an alternative exemplary swimwear garment.

Referring to FIG. 3, a deconstructed view of the garment 100 is shown, such as a view of the various pieces of the garment prior to sewing the front section 110, back section 112, sleeves 108, and zipper 130 together to create the garment 100.

In FIG. 3, the front section 110 is divided into the left front section 110A and the right front section 110B, and reattached with a full length zipper 130 running in between. the sleeves 108 can be raglan sleeves.

Raglan sleeves are a sleeve type, where the sleeve attaches to the front and rear sections of a shirt or other garment at a diagonal angle which spans all the way to the neck. Raglan sleeves, because the shoulder region has no seam running through it, allows freedom of motion in the shoulder region. Such a sleeve type is of particular benefit in the case of swimming due to the emphasis on shoulder motion and shoulder muscle development. The sleeves 108 are formed by cutting the compressive fabric 104 in a diamond-like shape. The sleeves are formed by sewing the fabric into a tube shape by attaching the underarm edges 302 together, by creating an underarm seam.

The structure of the base layer 102 is formed by sewing the side seams by sewing the front left edge 304 to the back left edge 306 and the front right edge 308 and the back right edge 310. In so doing, the left side of the front section 110A is connected with the left side of the back section 112 and the right side of the front section 110B is connected with the right side of the back section 112. Finally, the sleeves 108 are attached to the front section 110 and the back section 112 by sewing the raglan seams 312.

As shown in FIG. 3, the elastic straps 120 are not yet attached to the front section 110 or the back section 112, and are simply shown laying on top for reference. Thus, as discussed previously, when the underarm edges 302 are sewn to form the sleeve, the front end of the exterior elastic straps 120B are attached and sewn into the underarm seam. Similarly, when the raglan edges 312 are sewn to form the raglan seams, the interior elastic straps 120A are sewn into the raglan seam to be secured in place.

With regards to the seams discussed in FIG. 3, a complex stitching pattern can be used to form the seam, such as a cover stitch. Preferably, a double-sided 5 thread cover stitch is used to form the seams, as is shown in more detail in FIG. 4. This double-sided 5 thread cover stitch can be about 6 millimeters wide, and can be stitched on fabric overlapped by about 0.25 inches. Such a 5-thread cover stitch, sometimes called stitch number 605, uses 3 needles to form the stitch. Preferably, the cover thread will be double sided for improved strength in comfort.

It is also contemplated that similar cover stitching, such as a 4 thread or 6 thread cover stitch (stitch numbers 602 and 607 respectively). In addition, other durable stitch patterns could be used, such as a 4 or 5 thread safetystitch, or similar stitching pattern. While it is contemplated that a double sided stitch be used, a single sided stitch may also be used.

A 5 thread cover stitch provides several benefits over standard stitch patterns. In one aspect, the 5 thread cover seams are flat seams, compared to other seams which use extra fabric between the edge of the seam line and the edge of the fabric. The flat seams facing inside the suit help reduce chafing on the wearer, and when facing outside (as they are double sided) the seam design minimizes drag in the water. In another aspect, 5 thread cover stitch provides maximum durability, as it is both strong but also flexible, allowing the fabric to stretch in use. of strength, durability, and comfort against the wearer's body. Additionally, due to the slim profile of the 5 thread cover stitch, the bulkiness, and therefore drag created in the water, will be limited.

Figure 5A:
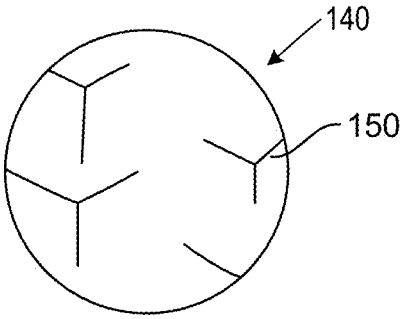
FIG. 5A is a detailed view of exemplary auxetic cuts.
Figure 5B:
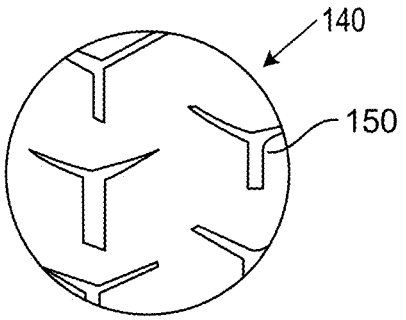
FIG. 5B is a detailed view illustrating the auxetic cuts of FIG. 5A when under strain.

Referring now to FIGS. 5A and 5B, a close up view of a panel 140 having auxetic cuts 150 is shown. FIG. 5A, shows the auxetic cuts 150 when no stretching or bending is applied to the panel 140. FIG. 5B shows the same view of a panel 140 having auxetic cuts 150 when a force is applied to the panels 140. As can be seen, the auxetic cuts 150 allow additional stretch and flexibility in comparison to the normal characteristics of the panels 140.

FIGS. 5A and 5B show one example of a shape of the auxetic cuts 150, being a three-sided star. Other embodiments may have auxetic cuts 150 which are straight lines, moon shapes, X shapes, Y shapes, and the like. The orientation of the shape relative to the orientation of the panel 140 on the base layer 102 can provide specific flexibility in one or multiple directions. For example, an auxetic cut 150 in a straight line shape and extending in a vertical direction on the garment 100 can allow additional stretch in a horizontal direction, while if stretched vertically (longwise for the auxetic cut 150) the stretching capability of the panel 150 remains relatively unchanged. Therefore, specific selection of the shape of the auxetic cuts 150 as well as size and depth of the auxetic cuts 150 can be based on desired range of motion in a particular area of the wearer's body. For example, the abdomen panels 140A are located approximately in the abdomen region of the wearer—an area of the body with a wide range of motion in rotating and bending. In such a region, the abdomen panels 140A could have three-sided stars or a similar shape which allows additional stretching of the abdomen panels 140A in multiple directions. The auxetic cuts 150 of a particular panel 140 or location on the wearer's body can also be determined based on what motion is necessary for a particular swimming stroke.

FIGS. 5A and 5B show the auxetic cuts 150 extending fully through the panel 140 such that the underside of the panel 140 is visible and exposed when fully stretched. In alternative embodiments, the auxetic cuts 150 may only partially extend through the panel 140, either on the outward facing side or the inward facing side. Selection of depth of the auxetic cuts 150 can vary to provide the panel 140 with more or less stretching ability. For example, an auxetic cut 150 that only extends partially through the panel 140 may provide additional stretch compared to a panel 140 not having any auxetic cuts 150, but more than a panel 140 having auxetic cuts 150 extending all the way through the panel 140. As such, the depth of the auxetic cut 150 can allow for specific selection of the desired stretch of a portion of a panel 140.

Figure 6:
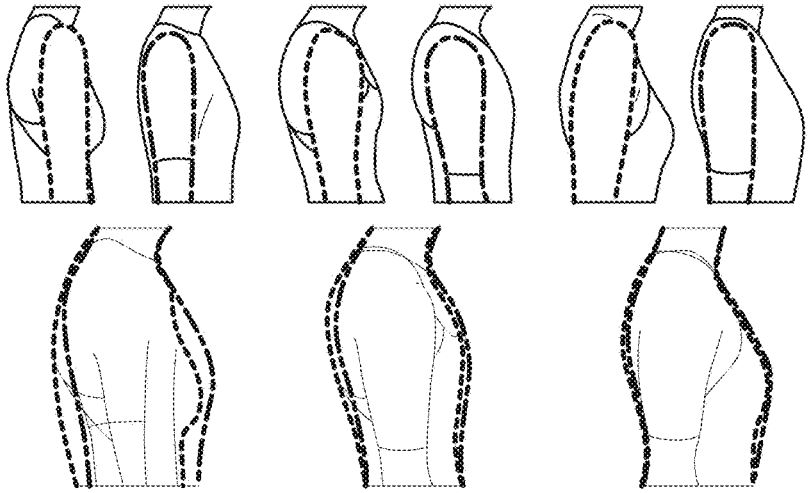
FIG. 6 illustrates experimental results in shoulder position when wearing the swimwear garment compared to wearing only a traditional swimsuit.

Referring now to FIG. 6, the images show experimental results of body position and posture difference when wearing the garment 100 compared to only a traditional training swimsuit. The top row of images shows the results of three test cases, sequentially from left to right the images show: the first test candidate without wearing the garment 100, the first test candidate wearing the garment 100, the second test candidate without wearing the garment 100, the second candidate wearing the garment 100, the third candidate without wearing the garment 100, the third test candidate wearing the garment 100. Over each photo is a super imposed outline showing the shoulder position of the test candidate.

The second row of images in FIG. 6 show the two images of each candidate super imposed on top of each other. The image of the test candidate wearing the garment 100 is made opaque in the image to better show contrast between the posture of the test candidate while wearing the garment 100 and not wearing the garment 100.

As can be seen, particularly in the second row of images of FIG. 6, the test candidate's posture is straightened when wearing the test garment 100. More specifically, the results show the elastic straps 120 provide a force on the shoulders to push their posture to be straighter. As can be seen for example in the left-most images, the garment 100 applies pressure such that the wearers shoulders are rolled backward, the back of the wearer is straightened, and the chest is raised.

Figure 7:
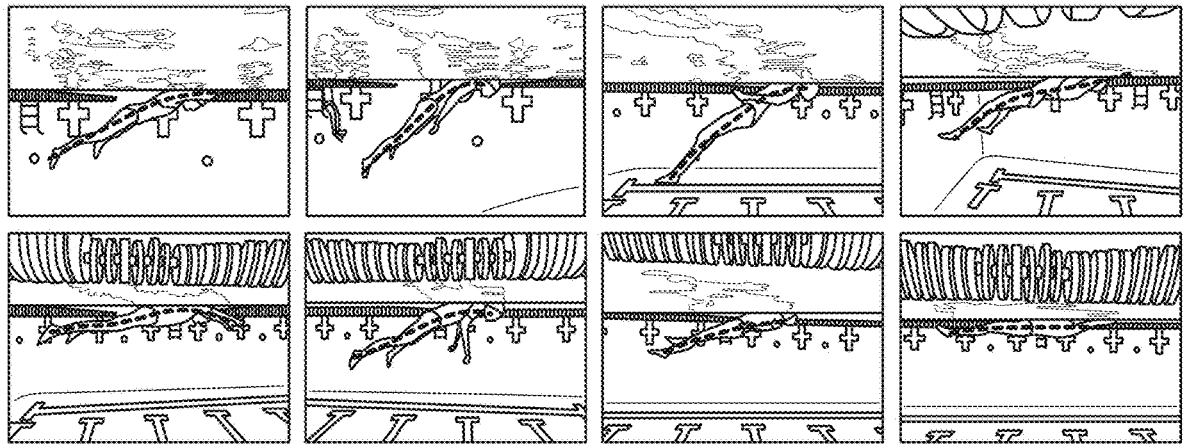
FIG. 7 illustrates experimental results in swimming form when wearing the swimwear garment compared to wearing only a traditional swimsuit.

Referring to FIG. 7, the images show experimental results of the garment 100 while worn in floating positions in the water. The upper row shows a test subject performing four different floating positions while in the water while only wearing a traditional training swimsuit. The second row shows the same test subject performing the same four floating positions while wearing the garment 100. As such, each column represents the same floating position with and without the garment 100 being worn by the subject. As can be seen, for example in the left-most column of images, the test subject's legs without the garment 100 (the upper left photo) are angled downward deeper into the water. In contrast, the same floating position while wearing the garment 100 (the lower left photo) shows the test subject's legs being substantially raised in the water, and much more level with the water's surface. The torso and legs being raised in the water improves swimming forms by streamlining the body's position. These results demonstrate an advantage of the garment 100 in assisting swimmers by providing buoyancy to the torso and lower legs to elevate and improve body position in the water.

The descriptions above have concentrated on describing particular aspects and features. It should be understood, however, that various aspects and features may be combined whenever practical without departing from the spirit and scope of the invention. That is, particular aspects and features described above with reference to one embodiment may be incorporated into one or more other embodiments, even though such alternate embodiments are not specifically shown.

It is understood that the examples and embodiments described herein are for illustrative purposes and that various modifications or changes in light thereof will be suggested to persons skilled in the art and are to be included within the spirit and purview of this application and the scope of the appended claims.

What is claimed is:

1. A training swimwear garment, comprising:

a base layer suitable to cover at least a portion of an upper torso of a wearer, the base layer having a front section and a back section, and wherein the base layer comprises a compressive fabric and a non-compressive fabric; a first sleeve attached to the front section by a first sleeve seam configured to be over a left pectoral region of the wearer, the first sleeve further comprising a first underarm seam; a second sleeve attached to the front section by a second sleeve seam configured to be over a right pectoral region of the wearer, the second sleeve further comprising a second underarm seam;

a plurality of buoyant panels connected with the base layer, the plurality of buoyant panels including at least one abdomen panel configured to cover an abdomen region of the wearer and configured to be extending along and not covering a ribcage of the wearer, and a back panel covering the back section, and wherein the plurality of buoyant panels are configured to produce a body posture of the wearer in water;

a plurality of elastic straps each sewn to the back panel in a rear of the garment, the plurality of elastic straps comprising a first interior strap sewn into the first sleeve seam in the front section, a second interior strap sewn into the second sleeve seam in the front section, a first exterior strap sewn into the first underarm seam in the front section, and a second exterior strap sewn into the second underarm seam in the front section, wherein the first interior strap and the first exterior strap are configured to be positioned on a left side of the wearer, the second interior strap and the second exterior strap are configured to be positioned on a right side of the wearer, wherein the first interior strap is configured to span over a top of a left shoulder of the wearer, wherein the second interior strap is configured to span over a top of a right shoulder of the wearer, wherein the first interior strap and the second interior strap are configured to extend towards a center of a spine of the wearer to apply a downward force on a shoulder region of the wearer, wherein the first exterior strap and the second exterior strap are configured to cross over the first interior strap and the second interior strap respectively, over the shoulder region of the wearer to apply a backwards force to the shoulder region of the wearer, wherein the plurality of elastic straps is configured to provide tension to produce a shoulder posture of the wearer; and wherein the first interior elastic strap and the first exterior elastic strap are extending from the front section to the back section of the base layer and merge together at a first point of intersection in the rear of the garment forming a first angle, the second interior elastic strap and the second exterior elastic strap are extending from the front section to the back section of the base layer and merge together at a second point of intersection in the rear of the garment forming a second angle.

2. The garment of claim 1, further comprising a zipper connected with the base layer, the zipper extending longitudinally in a center of a front of the garment.

3. The garment of claim 2, wherein the at least one abdomen panel includes two abdomen panels configured to cover the abdomen region of the wearer, the two abdomen panels arranged on either side of the zipper.

4. The garment of claim 3, wherein the two abdomen panels are substantially triangular in shape, configured to be broad towards a waist of the wearer and narrow as each of the two abdomen panels extends upwardly, away from the waist of the wearer.

5. The garment of claim 1, wherein the plurality of buoyant panels includes an oblique panel configured to cover an oblique muscle the wearer.

6. The garment of claim 1, wherein the plurality of buoyant panels is configured to provide compression on the abdomen region of the wearer and the back section to promote muscle activation.

7. The garment of claim 1, wherein the plurality of buoyant panels is at least partially made from neoprene.

8. The garment of claim 7, wherein the plurality of buoyant panels comprises at least one auxetic perforation.

9. The garment of claim 1, wherein a covering section is attached to the base layer with cover stitching, and wherein the covering section comprises a compressive fabric.

10. The garment of claim 1, wherein the plurality of buoyant panels is configured to raise a body position of the wearer in a body of water.

11. The garment of claim 1, wherein the first and second sleeve are each configured to extend to at least a middle-upper arm of the wearer and are at least partially made of the compressive fabric.

12. The garment of claim 11, wherein the first and second sleeve are each a raglan sleeve.

13. The garment of claim 1, wherein the back section of the base layer is made from the non-compressive fabric.

14. The garment of claim 13, wherein the front section of the base layer is made from the compressive fabric.

15. The garment of claim 14, wherein the compressive fabric is a polyester-spandex blend.

16. The garment of claim 1, wherein the garment is undersized relative to the wearer when dry such that the garment has a tightness against the wearer when the garment becomes wet.

17. The garment of claim 1, wherein the plurality of elastic straps is connected with the base layer in a stretched state such that the elastic straps provide additional tension on the wearer.

18. The garment of claim 1, wherein the plurality of elastic straps includes a polyester coating on a surface configured to face an upper torso of the wearer.

19. The garment of claim 1, wherein the base layer further comprises a plurality of seams made with double-sided cover stitching.

20. The garment of claim 1, wherein the back panel is narrow at an upper portion and increases in width near a middle of the back panel.

21. The garment of claim 20, wherein the back panel is curved at a bottom edge configured to be near a waist of the wearer.

* * * * *